United States Patent [19]

Miller et al.

[11] 4,188,622

[45] Feb. 12, 1980

[54] GARBAGE CAN ALARM

[76] Inventors: Larence G. Miller, 1499 Ringe La., Las Vegas, Nev. 89110; Rowland B. Purmal, 39 Lowery, Henderson, Nev. 89015

[21] Appl. No.: 873,411

[22] Filed: Jan. 27, 1978

[51] Int. Cl.[2] ..... G08B 13/12

[52] U.S. Cl. ..... 340/571; 340/548; 340/550; 340/573; 340/666; 200/52 R; 116/81

[58] Field of Search ..... 340/546, 540, 548, 550, 340/564, 541, 571, 573, 666, 665; 200/61.93, 61.43; 220/1 T; 116/4, 6, 67 R, 77, 81

[56] References Cited

U.S. PATENT DOCUMENTS

| | | | |
|---|---|---|---|
| 913,684 | 3/1909 | Bloch | 340/666 |
| 1,891,751 | 12/1932 | Coyne | 340/666 |
| 2,683,784 | 7/1954 | Rector | 340/666 |
| 3,696,373 | 10/1972 | Dunn et al. | 340/550 |

*Primary Examiner*—John W. Caldwell, Sr.
*Assistant Examiner*—Donnie L. Crosland
*Attorney, Agent, or Firm*—Clarence A. O'Brien; Harvey B. Jacobson

[57] ABSTRACT

A strap assembly constructed of shape retentive but deformable and resilient dielectric material. The strap assembly includes longitudinally spaced transversely extending corrugations and is adapted to encircle an upright trash can constructed of conductive material with a first side of the strap assembly opposing the outer surface of the trash can. The corrugations define ridges spaced along the first side for abutting engagement with the can and the assembly includes longitudinally spaced openings formed therethrough. Anchor structure is provided for releasably securing the strap assembly about the can and a conductor member is threaded through selected corrugations of the strap assembly and spans the openings. A battery and electrically actuatable signal generator are serially connected in circuit structure including the conductor member and a contact member electrically connects the circuit with the can, the conductor member being laterally displaceable into electrical contact with the can to close the circuit and thus cause the battery to electrically actuate the signal structure.

8 Claims, 5 Drawing Figures

GARBAGE CAN ALARM

BACKGROUND OF THE INVENTION

Various forms of residences and businesses utilize metallic cans in which to store trash and/or garbage. Although these cans may be provided with reasonably tight fitting closures, neighborhood and roaming dogs may readily smell edibles within the can and can be very persistent in tipping the cans and removing the closures in order to gain access to the edibles therein. This, of course, results in portions of the garbage or trash being strewn over the ground. In the past, various forms of trash and garbage can supports designed specifically to render it more difficult for dogs and other animals to tip trash cans have been designed. In addition, some trash cans are provided with interlocking lids. However, an intelligent dog or other animal is sometimes sufficiently persistent to gain access to the interior of cans supported from stands designed to prevent tipping of the cans and the interiors of cans provided with interlocking lids. Accordingly, a need exists for some form of alarm which will be operative to generate an audible signal when a trash can is being tampered with by a dog or other animal.

BRIEF DESCRIPTION OF THE INVENTION

The garbage can alarm of the instant invention comprises a strap assembly constructed of plastic or other suitable dielectric material and which may be secured about a trash can, horizontally, below and above the upper and lower ends of the can. The strap member is corrugated and includes longitudinally spaced openings formed therethrough and a conductor member is threaded through selected corrugations of the strap member and spans the openings and is thereby positioned for lateral deflection into contact with the portions of the can registered with the openings in the strap member. The conductor member is serially connected within a battery powered electrical signal generator circuit grounded to the can and electrical contact of any portion of the conductor member with the can is operative to complete the electrical circuit and thus to effect actuation of the electrically actuated signal generator.

The main object of this invention is to provide an alarm for a garbage can which will be capable of rendering an audible signal when the can is being tampered with by a dog or other animal or when the can has been tipped on its side.

Another object of this invention is to provide a garbage or trash can alarm constructed in a manner whereby it may be readily adapted for use in conjunction with garbage cans of different sizes.

Still another object of this invention is to provide a garbage can alarm constructed in a manner whereby a plurality of selectively usable attaching means may be utilized for attaching the alarm in operative position on the associated can.

A final object of this invention to be specifically enumerated herein is to provide a garbage can alarm in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
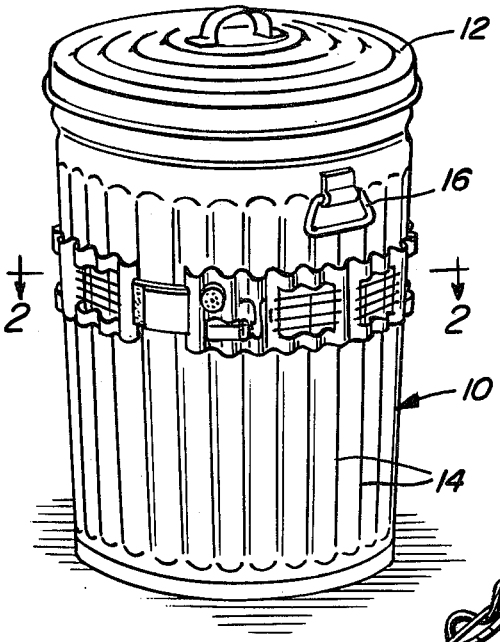
FIG. 1 is perspective view of a conventional form of garbage can with the alarm of the instant invention operatively associated therewith.

Referring now more specifically to the drawings, the numeral 10 generally designates a conventional garbage can including a removable top 12. The can 10 is constructed of metal and includes circumferentially spaced vertical corrugations 14 spaced thereabout below and above its upper and lower end portions, respectively. Opposite side upper portions of the can 10 include the usual diametrically opposite bail-type handles 16.

The alarm of the instant invention is referred to in general by the reference numeral 18 and includes an elongated stiff, but bendable strap assembly referred to in general by the reference numeral 20. The strap assembly 20 includes a strap member 22 constructed of shape retentive but formable and resilient dielectric material such as plastic and includes first and second inner and outer sides 24 and 26. The strap member 22 includes longitudinally spaced transversely extending corrugations 28 and also includes longitudinally spaced openings 30 formed therethrough inwardly of the opposite side marginal portions of the strap member 22.

An elongated conductor member 32 includes four reaches thereof extending longitudinally of the strap member 22 and the conductor member 32 is threaded through selected corrugations 28 of the strap member 22 and each reach of the conductor member 32 spans the openings 30. The opposite ends of the strap member 22 include coacting "Velcro" straps 34 and 36 releasably engageable with each other in adjusted overlapped engagement and the strap assembly 20 may thus be secured about the can 10 in the manner illustrated in FIGS. 1 and 2 of the drawings with those portions of the conductor member 32 spanning the openings 30 spaced slightly outwardly of the outer surfaces of the opposing portions of the can 10.

Figure 2:
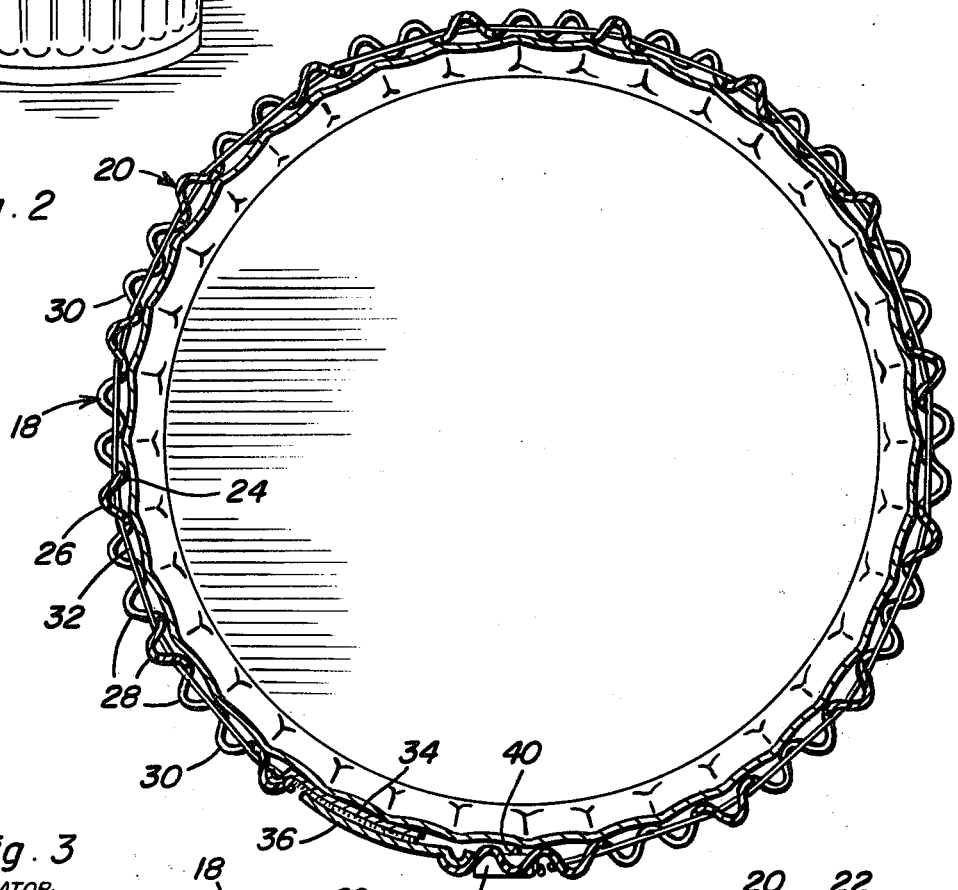
FIG. 2 is an enlarged horizontal sectional view taken substantially upon the plane indicated by the section line 2—2 of FIG. 1.
Figure 3:
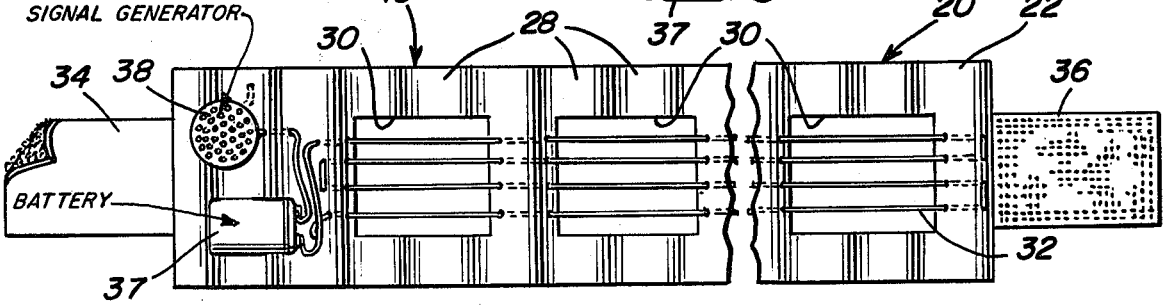
FIG. 3 is a fragmentary plan view of the alarm assembly.

The conductor member 32 is serially connected in an electrical circuit including a storage battery 37 and an electrically actuatable audible signal generator 38 in the form of a buzzer and the electrical circuit includes a contact 40, see FIG. 2, projecting inwardly of the inner side 24 of the strap member 22 for electrical contact with the can 10.

After the strap assembly 20 has been secured about the can 10 in the manner illustrated in FIGS. 1 and 2 of the drawings, a dog or other animal tampering with the can 10 may accidentally inwardly depress the portion of one of the reaches of the conductor member 32 extending across one of the openings 30 into electrical contact with the can thereby completing the circuit between the battery 37 and the electrically actuated signal generator 38 to thereby actuate the latter and render an audible signal. Further, if the dog or other animal tips the can 10 over on its side, one of the reach portions of the conductor member 32 may be inwardly deflected into electrical contact with the can 10 and thereby also actuate the signal general 38 as a result of the can 10 being tipped on its side.

Figure 4:
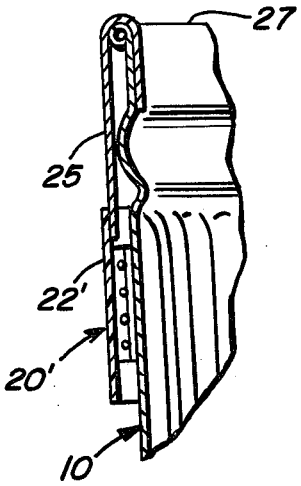
FIG. 4 is a fragmentary enlarged vertical sectional view illustrating the garbage can alarm of the instant invention supported from an associated garbage can by means of longitudinally spaced hooks engageable over the upper marginal edge of the garbage can.

With attention now invited more specifically to FIG. 4 of the drawings, there will be seen a modified form of strap assembly referred to in general by the reference numeral 20' and from whose strap member 22' (corresponding to the strap member 22) a plurality of longitudinally spaced hooks 25 are supported and project from one marginal edge portion of the strap member 22'. The hooks 25 are removably engageable over the upper marginal portion 27 of the can 10 and are thereby also operative to support the strap assembly 20' from the associated can. Of course, the strap assembly 20' may also include "Velcro" straps corresponding to the straps 34 and 36.

Figure 5:
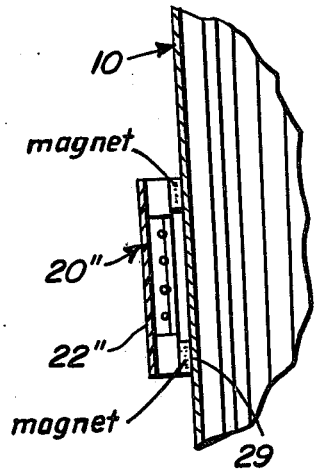
FIG. 5 is a fragmentary vertical sectional view illustrating another form of alarm constructed in accordance with the present invention utilizing magnets for securing the alarm in position upon an associated garbage can.

With attention now invited more specifically to FIG. 5 of the drawings, there may be seen still another form of strap assembly referred to in general by the reference numeral 20'' and whose strap member 22'' includes a plurality of longitudinally spaced magnets 29 spaced along the opposite longitudinally marginal edge portions thereof for magnetic attachment of the strap member 22'' to the associated can 10. Further, the strap member 22'' may also include strap members corresponding to the strap members 34 and 36, if desired. In any event, the strap assemblies 20, 20' and 20'' are all operative in substantially the same manner for electrically actuating the associated signal generator upon electrical contact of a portion of one of the corresponding conductor members with the side of the associated can 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, an elongated stiff but bendable strap assembly constructed of shape retentive but deformable and resilient dielectric material and including first and second sides and longitudinally spaced transversely extending corrugations and being adapted to encircle an upright trash can constructed of conductive material with said first side opposing the outer surface of said trash can, said corrugations including ridges spaced along said first side for abutting engagement with said can and said assembly including longitudinally spaced openings formed therethrough, said strap assembly including anchor means for releasably securing said strap assemby in position extending about said can, a conductor member threaded through selected corrugations and spaning said openings, and battery and electrically actuatable signal means supported from said strap assembly, open circuit means serially connecting said battery, signal means and said conductor member and including contact means disposed outwardly of said one side of said assembly for electrical contact with said can, said conductor member being adapted to engage said can and close said circuit means.

2. The combination of claim 1 wherein said anchor means includes a pair of releasably engageable strap members carried by the opposite ends of said strap assembly.

3. The combination of claim 2 wherein said strap members comprise "Velcro" strap members.

4. The combination of claim 1 wherein said anchor means includes magnet members carried by said strap assembly for magnetic attachment to said can.

5. The combination of claim 1 wherein said anchor means includes hook members spaced along one marginal edge portion of said strap member for removable engagement over the upper marginal edge of said can.

6. The combination of claim 1 wherein said conductor member includes a plurality of generally parallel electrically connected reaches thereof extending longitudinally of said strap assembly, threaded through said selected corrugations and spanning said openings.

7. The combination of claim 1 wherein said electrically actuatable signal means comprises an audible signal generator.

8. The combination of claim 1 wherein said strap assembly is constructed of plastic.

* * * * *